US007422288B2

(12) United States Patent
Ahearn

(10) Patent No.: US 7,422,288 B2
(45) Date of Patent: Sep. 9, 2008

(54) CHAIR ARM REST SYSTEM

(76) Inventor: David J. Ahearn, 10 High Meadow Rd., Little Compton, RI (US) 02837

( * ) Notice: Subject to any disclaimer, the term of this patent is extended or adjusted under 35 U.S.C. 154(b) by 0 days.

(21) Appl. No.: 12/021,580

(22) Filed: Jan. 29, 2008

(65) Prior Publication Data

US 2008/0179934 A1 Jul. 31, 2008

Related U.S. Application Data

(60) Provisional application No. 60/886,978, filed on Jan. 29, 2007.

(51) Int. Cl.
*A47C 7/54* (2006.01)

(52) U.S. Cl. ..... 297/411.39; 297/227; 297/411.25; 297/411.38; 297/411.4

(58) Field of Classification Search ..... 297/227, 297/228, 411.23, 411.25, 411.38, 411.39, 297/411.4

See application file for complete search history.

(56) References Cited

U.S. PATENT DOCUMENTS

| | | | | | |
|---|---|---|---|---|---|
| 1,737 | A | * | 8/1840 | King | 297/313 |
| 366,514 | A | | 7/1887 | Scarritt et al. | |
| 2,535,138 | A | | 12/1950 | Johnson | |
| 2,618,313 | A | | 11/1952 | Piotrasohke | |
| 2,655,200 | A | | 10/1953 | Lorenz | |
| 2,844,193 | A | | 7/1958 | Lauterbach | |
| 2,985,226 | A | | 5/1961 | Maurer et al. | |
| 3,089,741 | A | | 5/1963 | Burton | |
| 3,172,699 | A | | 3/1965 | Naughton | |
| 3,223,448 | A | | 12/1965 | Naughton | |
| 3,357,740 | A | | 12/1967 | Vaughn et al. | |
| 3,514,153 | A | | 5/1970 | Maurer et al. | |
| 3,578,379 | A | * | 5/1971 | Taylor et al. | 297/411.2 |
| 3,661,421 | A | * | 5/1972 | Johnson | 297/411.32 |
| 3,774,965 | A | | 11/1973 | Brandt et al. | |
| 3,806,192 | A | | 4/1974 | Ohlrogge et al. | |
| 4,131,315 | A | | 12/1978 | Vogtherr | |
| 4,492,407 | A | | 1/1985 | Broadhead | |
| 4,541,671 | A | | 9/1985 | Broadhead et al. | |
| 4,703,974 | A | | 11/1987 | Brauning | |
| 4,887,866 | A | | 12/1989 | Rusin | |
| 5,407,249 | A | * | 4/1995 | Bonutti | 297/411.35 |
| 5,733,010 | A | * | 3/1998 | Lewis et al. | 297/411.32 |
| 5,810,438 | A | | 9/1998 | Newhouse | |
| D420,225 | S | | 2/2000 | Lamb et al. | |
| 6,196,632 | B1 | * | 3/2001 | De Lucchi et al. | 297/451.1 |

* cited by examiner

*Primary Examiner*—Peter R. Brown
(74) *Attorney, Agent, or Firm*—Barlow, Josephs & Holmes, Ltd.

(57) ABSTRACT

A chair arm rest system containing a chair having a vertical chair member hingedly connected to a horizontal chair member. A base proximal to the vertical chair member is attached to the horizontal chair member. The arm rest post is spring-biased towards the horizontal chair member but pivots in opposition of the spring towards the vertical chair member. A distal end of the arm rest post is pivotally attached to the top end of the base. An arm rest surface is attached to a proximal end of the arm rest post. A first end of a sling is attached to the vertical chair member. A second end of the sling is connected to the arm rest surface. In operation, by moving the vertical chair member relative to the horizontal chair member, the sling self-adjusts and the spring-biased arm rest post pivots towards the vertical chair member.

7 Claims, 15 Drawing Sheets

CHAIR ARM REST SYSTEM

CROSS REFERENCE TO RELATED APPLICATION

This application is related to and claims priority from earlier filed provisional patent application Ser. No. 60/886,978, filed Jan. 29, 2007 and incorporated herein by reference.

BACKGROUND OF THE INVENTION

The present invention relates generally to arm rests. In particular, the present invention relates to arm rests for medical chairs, such as those used for supporting a user during dentistry and ophthalmic surgery.

In the prior art, arm rests are very well known as support structures in chairs. Arm rests typically are attached to either the seat bottom or the seat back and emanate in a general lateral direction. A typical arm rest is positioned so that the forearms and elbows of the user can rest thereon. For example, it is common to position the arm rests parallel to the seat bottom for comfort. However, it is also common to position the arm rests perpendicular to the seat back for comfort. Moreover, many chairs provide the ability to position arm rests at any angle relative to the seat back and seat bottom. Such position depends on the desires of the user.

Seats and chairs, for use in medical surgery, have specific issues not found in typical seating. Surgery chairs, such as for dental and ophthalmic surgeries, are commonly reclined and raised frequently. During use, a user typically enters the chair when it is upright for ease of access. The user is frequently examined when the chair is in its upright position. Thus, there is a need for user comfort and arm control when the chair is in this position.

For example, U.S. Pat. No. 3,223,448 shows an arm support for a contour dental chair. In use, when the back rest of the chair is in an upright position, the arm members and the arm support are positioned on top of the chair arms and generally follow the contour of the back rest. When the user is moved to a reclined position by pivoting the back rest unit rearwardly, the arm members fail to tension the chair arms to pivot for a comfortable position for the user.

For many procedures, the prior art chair is commonly reclined to the point of where the user is lying substantially flat. As shown in prior art FIGS. 1-3, there is an example of a prior art dentist chair having straps attached to the chair back and the arm rest. FIG. 1 shows the straps taught with the chair in the inclined position. FIG. 2 shows the chair in a fully reclined position where the straps appear taught and minimal flexibility to accommodate a user's arms. As shown in FIG. 3, in a fully reclined position of the prior art chair, the straps are not properly tensioned to hold the arms and shoulder of the user in the proper position.

Therefore, there is a need in the medical industry, particularly dentistry and opthalmology, to provide a chair with arm and shoulder rests that provide comfort and control in both the inclined and reclined positions. There is a need for a chair that continually self-adjusts and self-tensions its arm rests at all points of recline as a means of supporting the arm and shoulder at all times.

BRIEF SUMMARY OF THE INVENTION

An embodiment of the present invention preserves the advantages of prior art chair arm rest systems. In addition, it provides new advantages not found in currently available chair arm rest systems and overcomes many disadvantages of such currently available chair arm rest systems.

The chair arm rest system of the present invention contains a chair having a vertical chair member hingedly connected to a horizontal chair member. A bottom end of a base proximal to the vertical chair member is attached to the horizontal chair member. The arm rest post is spring-biased towards the horizontal chair member but pivots in opposition of the spring towards the vertical chair member. A distal end of the arm rest post is pivotally attached to a top end of the base. An arm rest surface is attached to a proximal end of the arm rest post. A first end of a sling is attached to the vertical chair member. A second end of the sling is connected to the arm rest surface. In operation, by moving the vertical chair member relative to the horizontal chair member, the sling self-adjusts and spring-biased arm rest post pivots towards the vertical chair member to provide a comfortable position for the user's arms and shoulder.

It is therefore an object of the present invention to provide a chair with arm and shoulder rests that provide comfort and control in both the inclined and reclined positions and all positions in between.

It is a further object of the present invention to provide a chair that continually self-adjusts its arm rests at all points of recline as a means of supporting the arm and hand.

It is also an object of the present invention to provide a chair that continually self-tensions its sling over a range of movement as a means of comfortably supporting the arm and shoulder.

Another object of the embodiment is to provide a chair arm rest system that is ergonomic to avoid injury to users especially during operative procedures by a practitioner.

Other objects, features and advantages of the invention shall become apparent as the description thereof proceeds when considered in connection with the accompanying illustrative drawings.

BRIEF DESCRIPTION OF THE DRAWINGS

The novel features which are characteristic of the chair arm rest system are set forth in the appended claims. However, the chair arm rest system, together with further embodiments and attendant advantages, will be best understood by reference to the following detailed description taken in connection with the accompanying drawings in which:

DETAILED DESCRIPTION OF PREFERRED EMBODIMENTS

Referring to FIGS. 4-15, a self-tensioning or self-adjusting chair arm rest system 10 of the present invention is shown. The present invention addresses the problem of control of the user's arms, shoulders and hands when a user is seated in a chair having a variable position. This is particularly important when the user is sedated and control of the user's body parts is inhibited.

Figure 1:
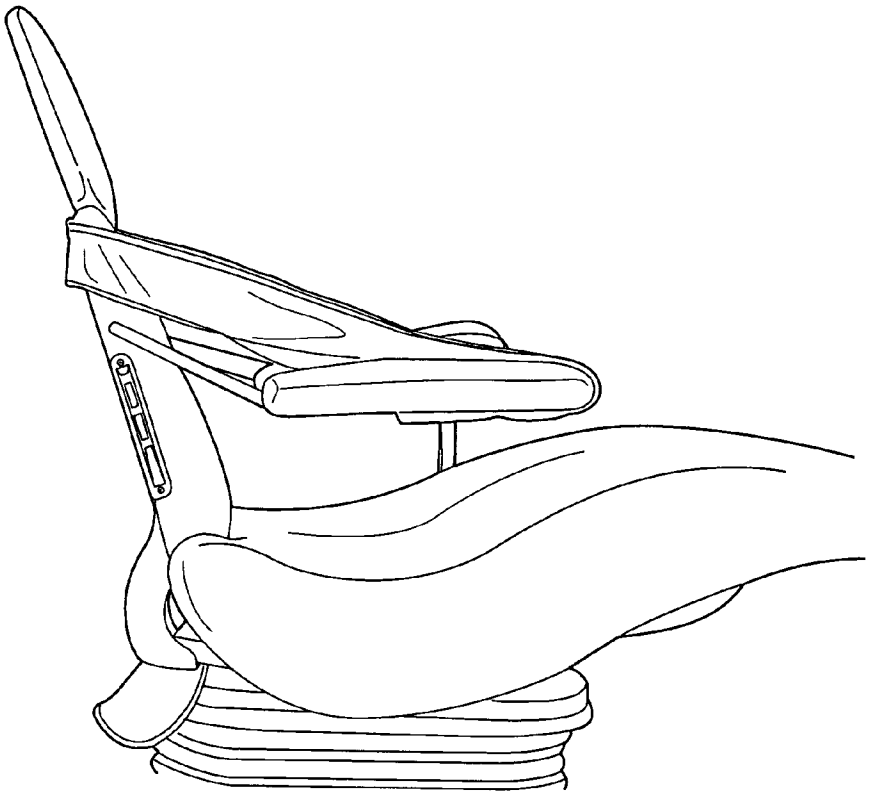
Fig. 1 Prior Art
FIG. 1 is a side view of a prior art chair at an inclined position.
Figure 2:
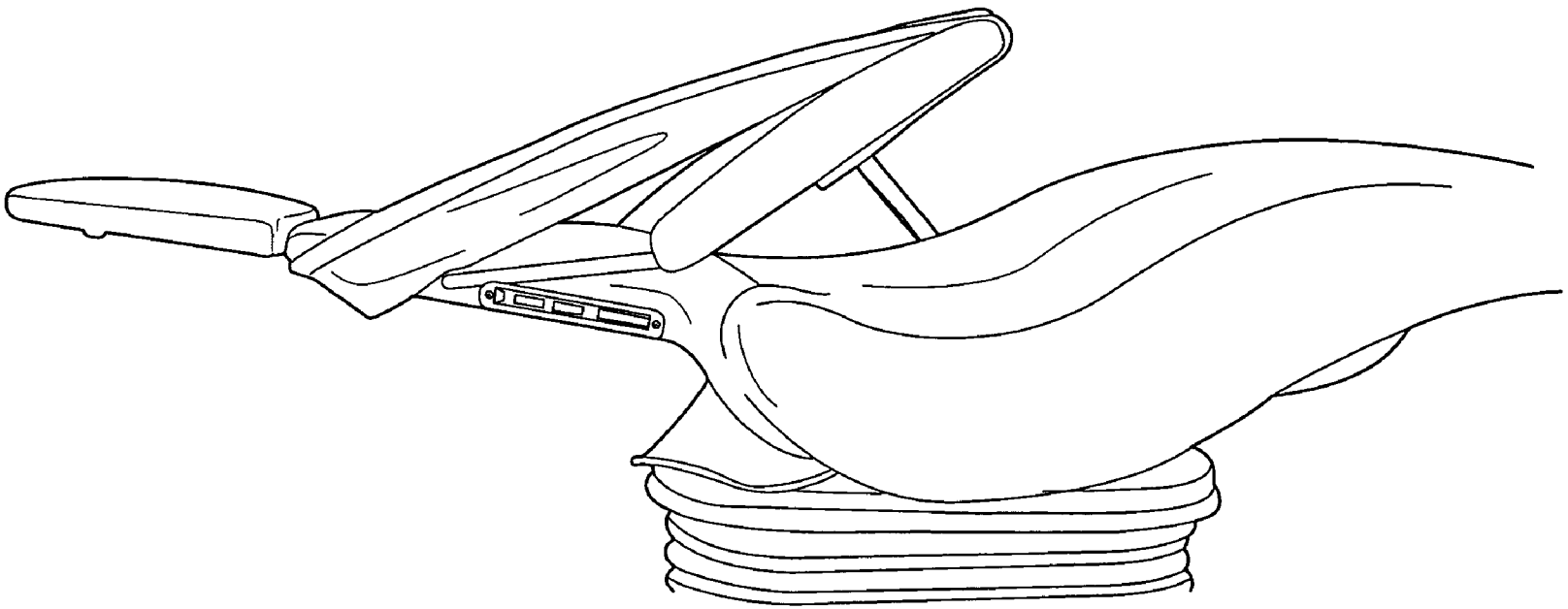
Fig. 2 Prior Art
FIG. 2 is a side view of the prior art chair of FIG. 1 at a fully reclined position.
Figure 3:
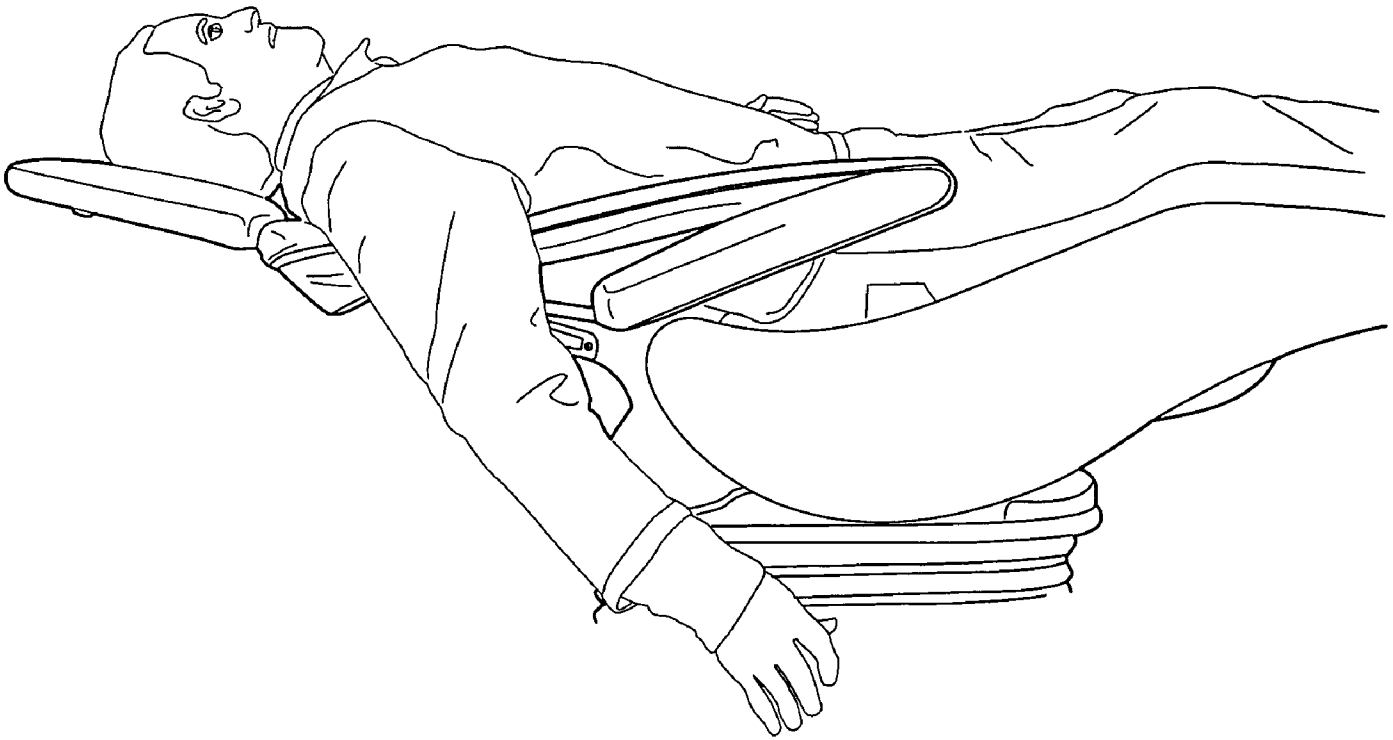
Fig. 3 Prior Art
FIG. 3 is a side view of the prior art chair of FIG. 1 at a fully reclined position in operation with a user.
Figure 4:
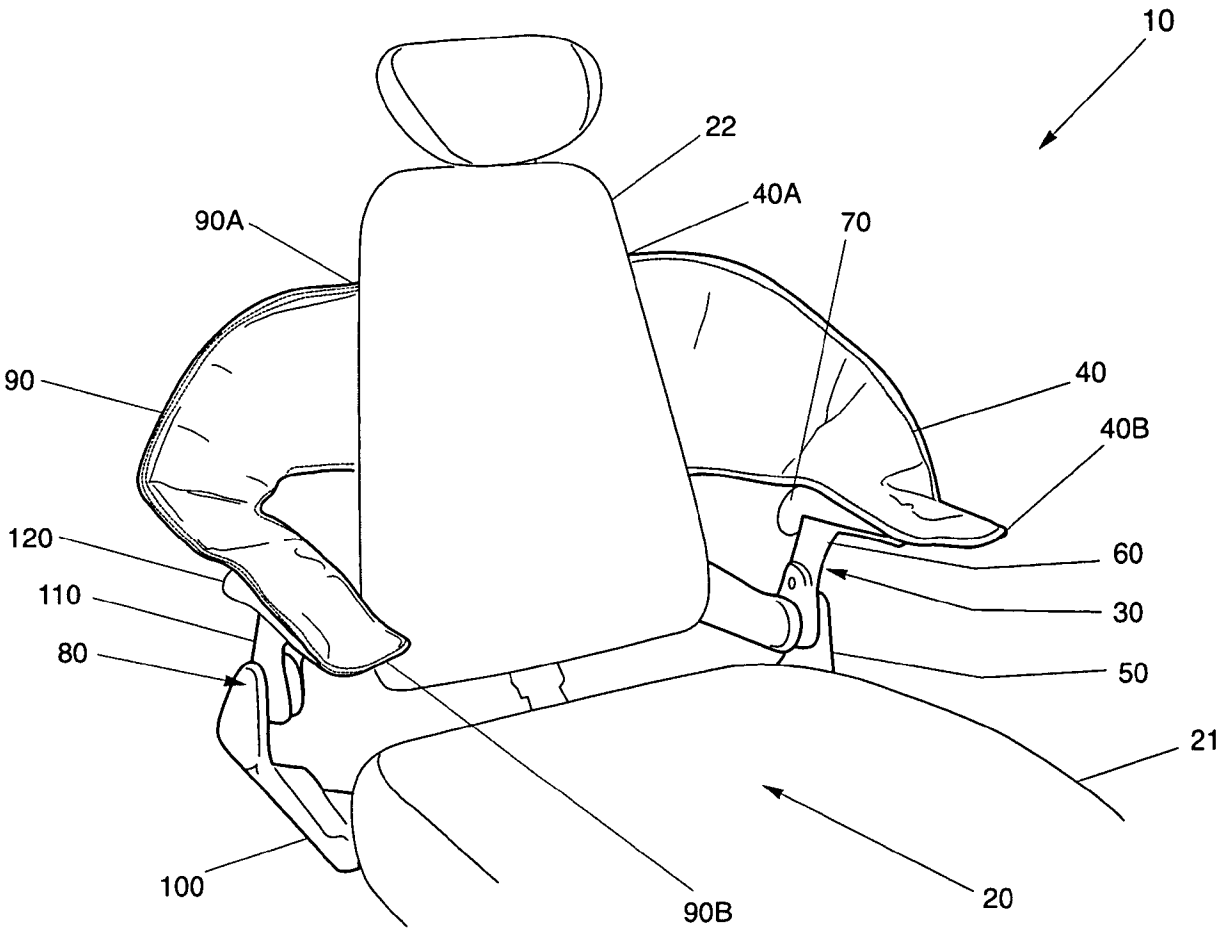
FIG. 4 is a perspective view of the chair arm rest system in accordance with the present invention.

Referring to FIG. 4, the chair arm rest system 10 of the present invention is shown. The chair arm rest system 10 contains a chair 20, arm rests 30,80, and slings 40,90. Most importantly, the slings 40,90 and arm rests 30,80 are self-tensioned or self-adjusted to ergonomically support the arms, hands, and shoulder of a user throughout a range of positions of the chair 20. The chair 20, preferably used in dental or medical environment, contains a horizontal chair member 21 and a vertical chair member 22. The vertical chair member 22 is hingedly connected to the horizontal chair member 21 for moving from an inclined position to a reclined position. It should be noted that the left and right side of the chair arm system 10 are mirror images of one another including the slings 40,90 and arm rests 30,80.

Figure 5:
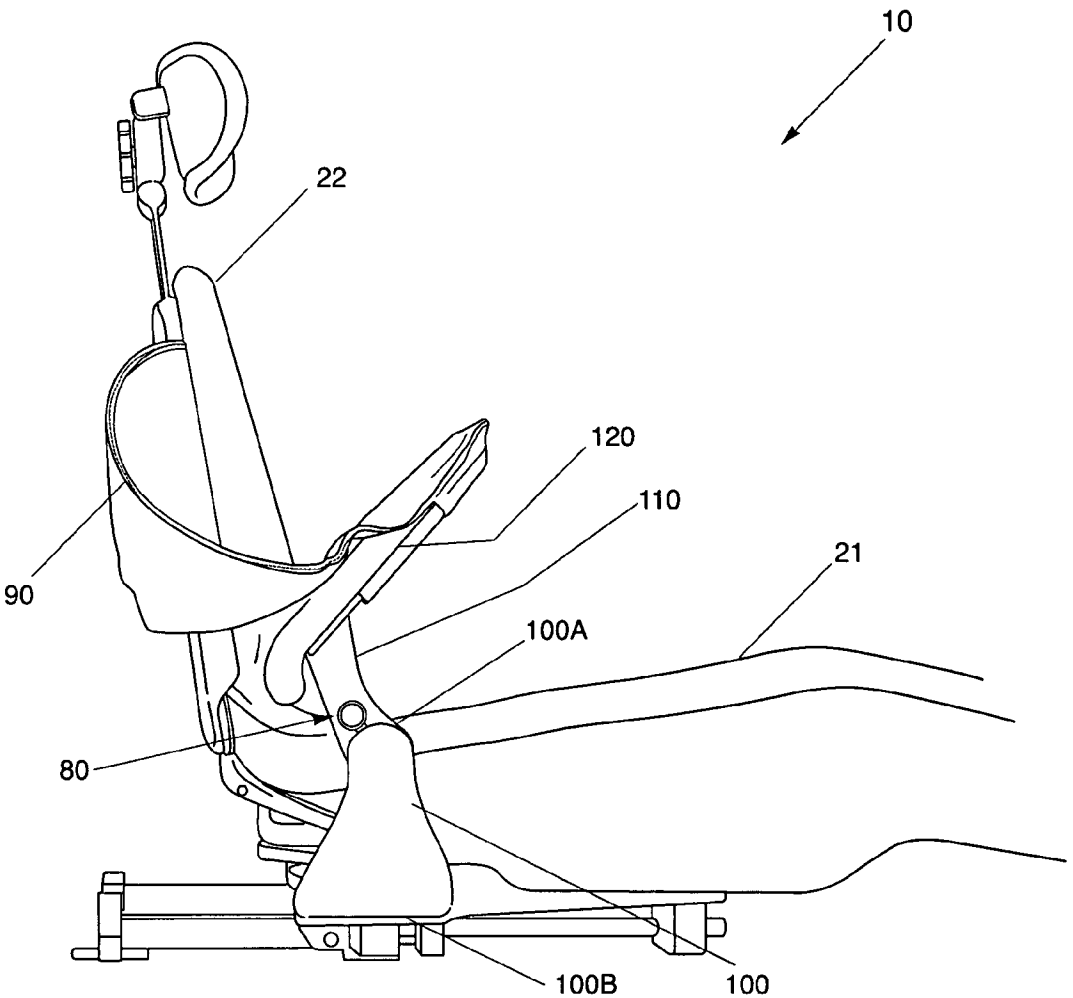
FIG. 5 is a left side view of the chair arm rest system of FIG. 4 with the chair in an upright position.

The arm rests 30,80 contain a base 50, 100, an arm rest post 60,110, and an arm rest surface 70,120. Referring to FIG. 5, a base 100 is positioned proximal to the vertical chair member 22 and mounted to the horizontal chair member 21. The base 100 has a top end 100A and a bottom end 100B. The bottom end 100B is attached to the horizontal chair member 21. The top end 100A is pivotally attached to the arm rest 80.

Figure 6:
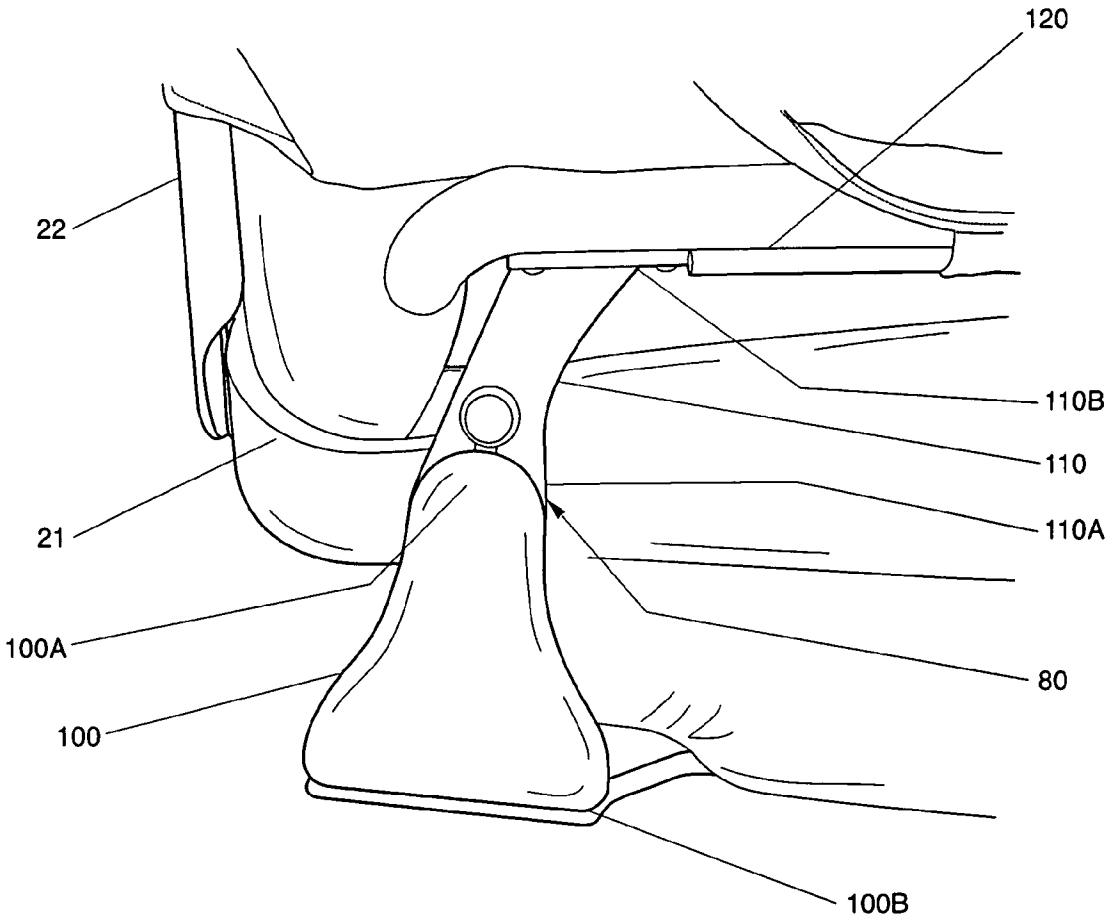
FIG. 6 is a left side view of the arm rest used in FIG. 4.
Figure 7B:
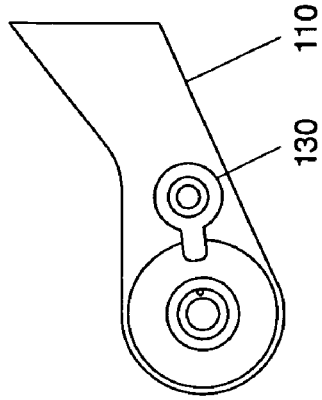
FIG. 7B is a side view of the arm rest post of the arm rest shown in FIG. 6.
Figure 7A:
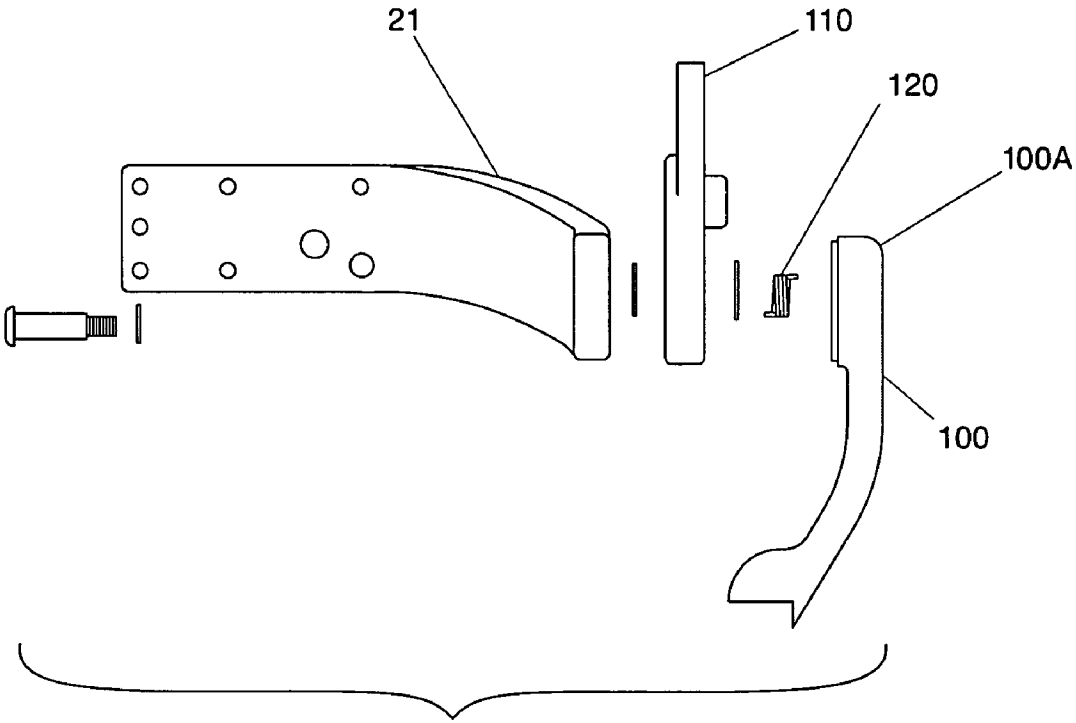
FIG. 7A is an exploded view of the arm rest shown in FIG. 6.

Referring to FIG. 6, the self-adjusting arm rest post 110 is spring-biased throughout a range of positions of the chair 20. The arm rest post 110 contains a proximal end 110B and a distal end 110A. The distal end 110A of the arm rest post 110 is pivotally attached to the top end 100A of the base 100. For example, as shown in FIG. 7A, a spring 120, such as a torsion spring or coiled ribbon spring, is positioned between the top end 100A of the base and the distal end 110A of the arm rest 110 post to allow for spring-bias of the arm rest 80. The arm rest post 110 is spring-biased towards the horizontal chair member 21 but pivots in opposition of the spring 120 towards the vertical chair member 22. It should be noted that any spring 120 may be used depending on the desired spring-bias. Also, the tension of the spring 120 can be adjusted, if desired. As shown in FIG. 7B, a stop 130 is provided on the arm rest post 110 to limit the movement of the arm rest post 110 relative to the base 100.

Figure 8:
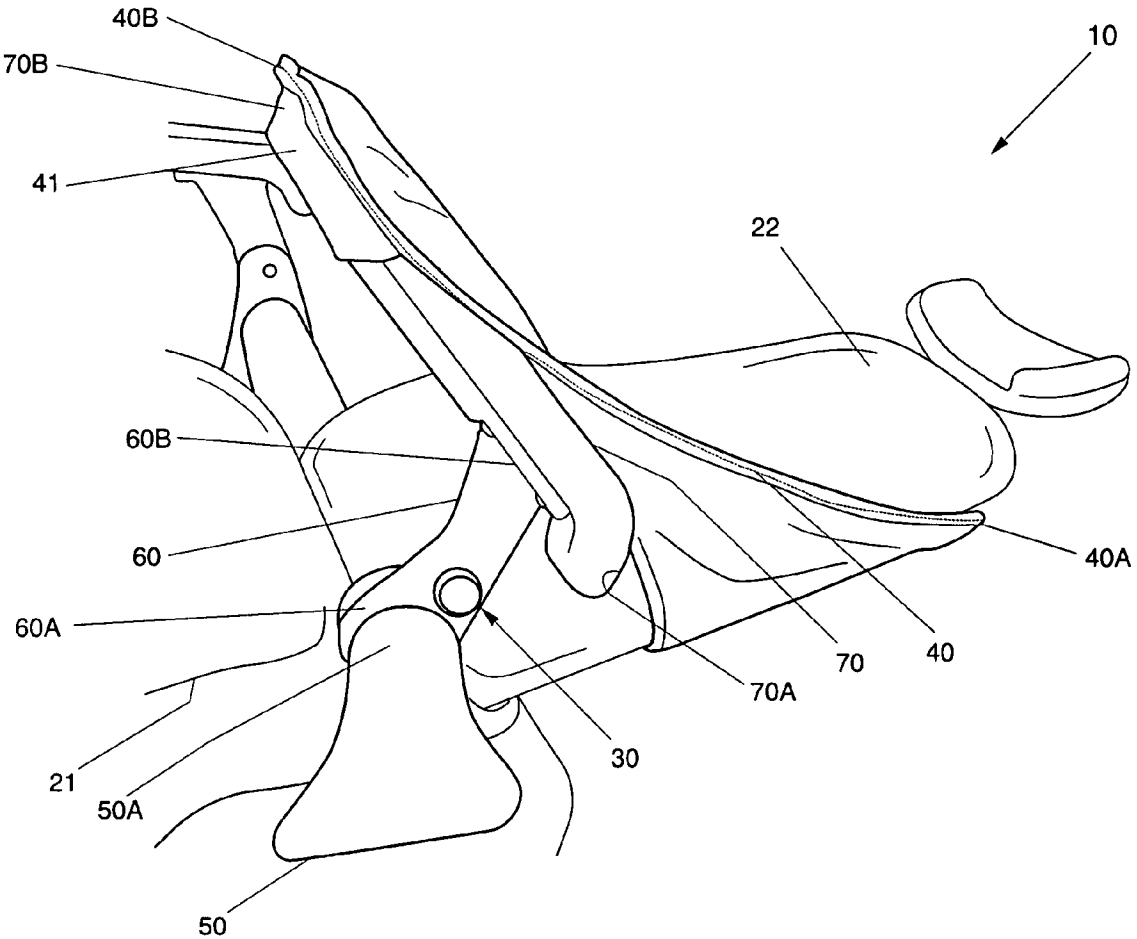
FIG. 8 is a right side view of the chair arm rest system of FIG. 4 with the chair in a reclined position.

Referring to FIG. 8, the arm rest surface 70 is attached to a proximal end 60B of the arm rest post 60. A distal end 60A of the arm rest post 60 is pivotally attached to a top end 50A of the base 50. The arm rest surface 70, in one embodiment, is perpendicular to the arm rest post 60.

The arm rest surface 70 has an inner portion 70A and an outer portion 70B. The outer portion 70B of the arm rest surface 70 is designed to receive the sling 40 which will be described further below. The inner portion 70A of the arm rest 70 in one configuration is curved downward. The arm rest surface 70 contains material that facilitates ergonomic resting of the user's arms and hands. In one embodiment, the arm rest surface 70 contains rubber, foam, or materials used in prior art chairs.

Figure 9:
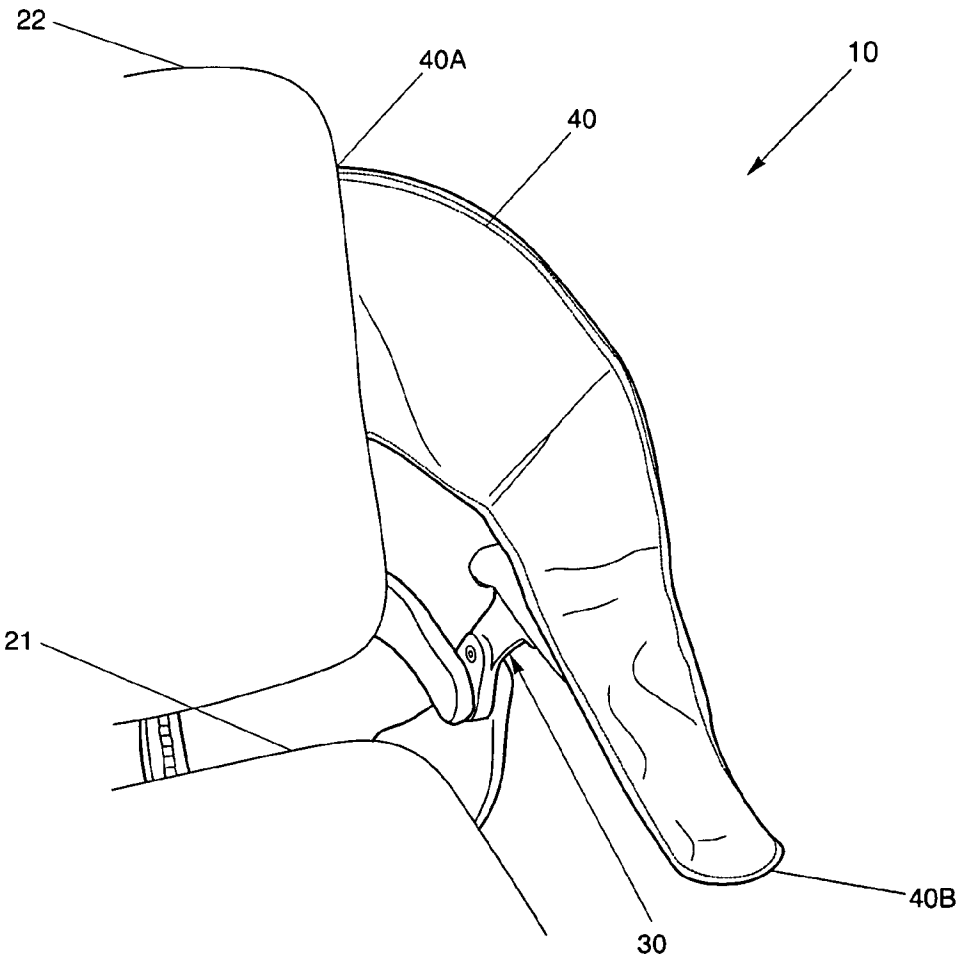
FIG. 9 is an elevated view of the sling for use in the present invention of FIG. 4.

Referring to FIG. 9, the sling 40 spans from a first end 40A connected to the vertical chair member 22 to a second end 40B connected to the arm rest 30. Preferably, the first end 40A is connected along an upper portion of the vertical chair member 22. The sling 40 is ergonomically designed for providing support both to the arms and shoulder areas of a user.

Referring back to FIG. 8, the second end 40B of the sling 40 defines a pocket or sleeve 41 for fitting or slipping over the outer portion 70B of the arm rest surface 70. Alternatively, the second end 40B of the sling 40 may be fixedly attached to the arm rest 30 so long as the proper tensioning of the sling 40 is maintained in any position of the chair arm rest system 10.

Figure 10:
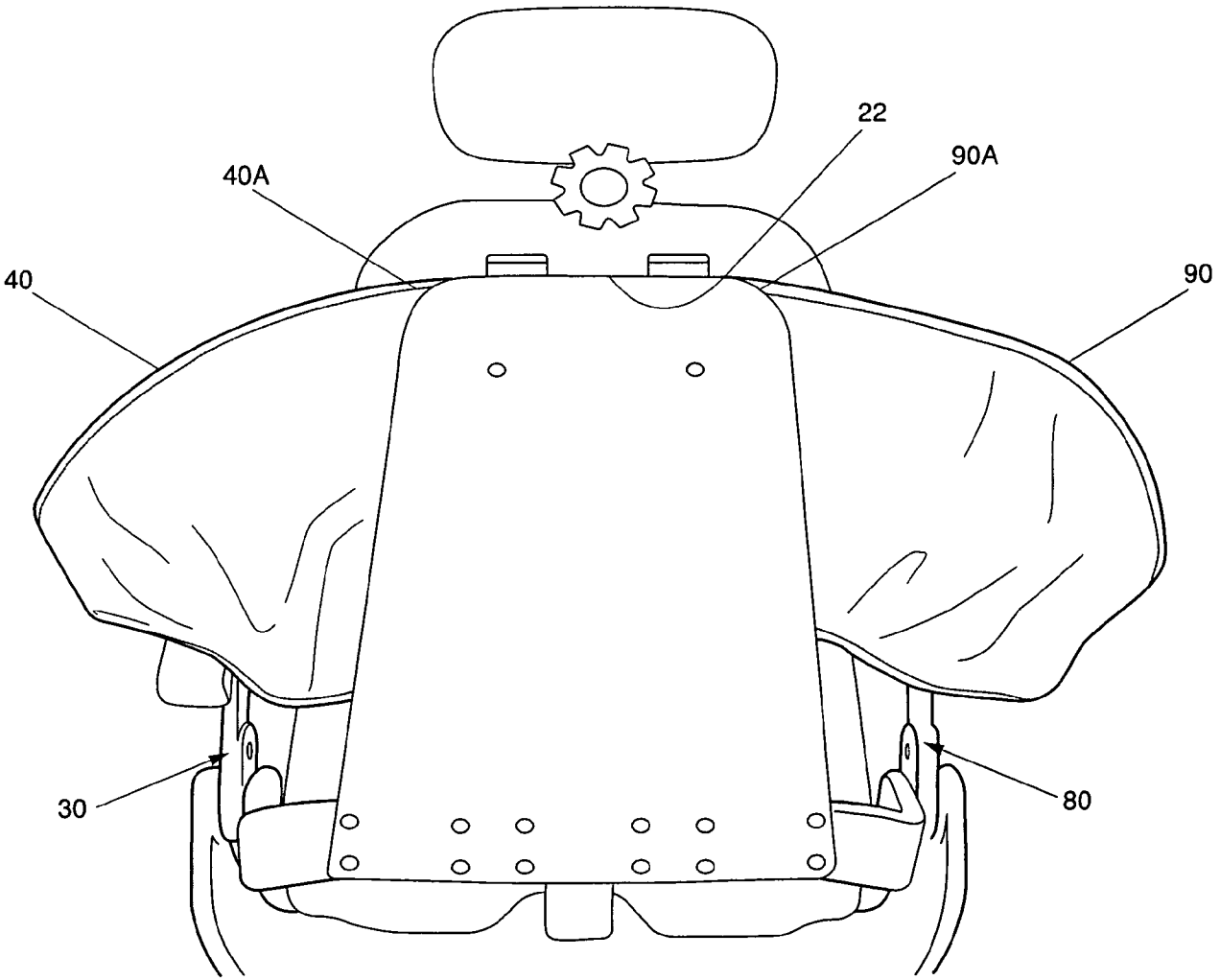
FIG. 10 is a rear view of the chair arm rest system of FIG. 4.

Referring to FIG. 10, the first ends 40A, 90A of the slings 40,90 are attached to a rear of the vertical chair member 22 proximal to the user's shoulder and arm area. The slings 40,90 are removably or permanently attached along the rear of the vertical chair member 22 depending upon a user's preference. For instance, for user's who are obese, the user may attach the slings 40, 90 at a point of attachment lower on the vertical chair member 22 to provide an ergonomic fit to the user. It should be noted that the chair arm rest system 10 may contain more than one arm rest 30,80 or sling 40,90.

The slings 40,90 are preferably designed to ergonomically support the arm and shoulders of the user. The first ends 40A, 90A of the slings 40,90, in one configuration, has a width at least twice the size of a width of the second ends 40B,90B of the slings 40,90. More importantly, the slings 40,90 have a substantially increased width along its length between the vertical chair member 22 and the inner portion 70A,120A of the arm rest surface 70,120. Preferably, the substantially increased width area defines a curved profile. The additional width of the sling 40,90 between the vertical chair member 22 and the inner portion 70A, 120A provides more surface area to ergonomically support the arms and shoulders of the user.

Referring to FIGS. 11-15, the chair arm rest system 10 of the present invention is shown in operation with a user seated in the chair 20 moving from the inclined position to a reclined position. The ergonomic construction of the chair arm rest system 10 provides comfort throughout the range of positions. During this movement of the chair 20, the vertical chair member 22 hingedly moves relative to the horizontal chair member 21 to self-tension the sling 90 while pivoting the spring-tensioned arm rest post 110 towards the vertical chair member 22.

Figure 11:
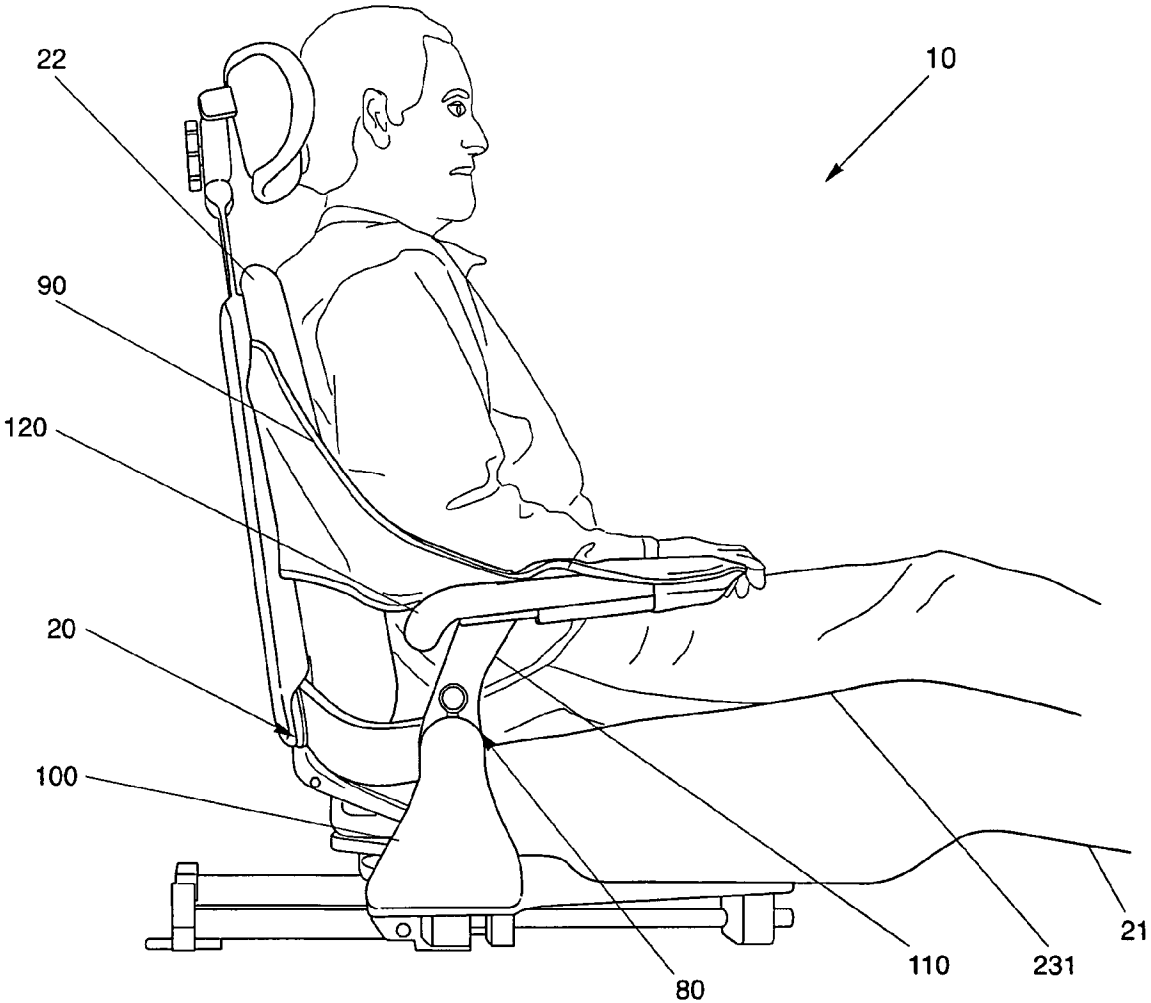
FIG. 11 is a left side view of the chair arm rest system of FIG. 4 in operation at a first position.

Referring to FIG. 11, the chair 20 is in a first position or fully inclined. In a first position, the arm rest surface 120 is substantially horizontal. In this first position, the sling 90 is substantially loose whereby the user can easily and comfortably place their elbow within the loose portion of the sling 90. The forearm and hand can easily rest on a portion of the sling 90 respectively positioned above the arm rest surface 120.

Figure 12:
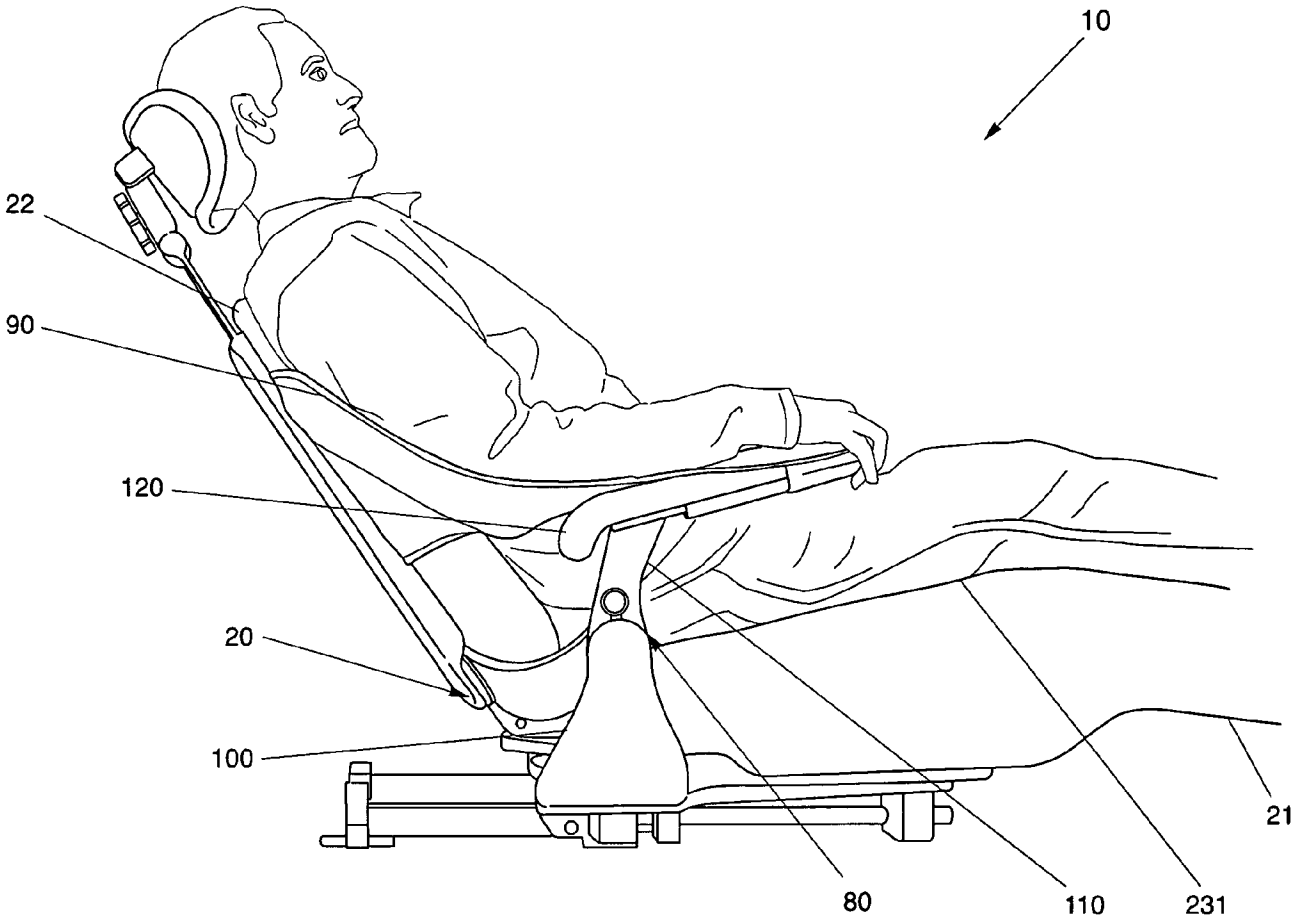
FIG. 12 is left side view of the chair arm rest system of FIG. 4 in operation at a second position.

In FIG. 12, the chair 20 is in a second position moving towards a reclined position. In the second position, the sling 90 maintains its flexibility and begins to pull on the arm rest surface 120 against the forces of the spring-biased tension of the arm rest post 110. Note, throughout the range of positions, the user's elbow is ergonomically supported in a central or middle portion of the sling 90.

Figure 13:
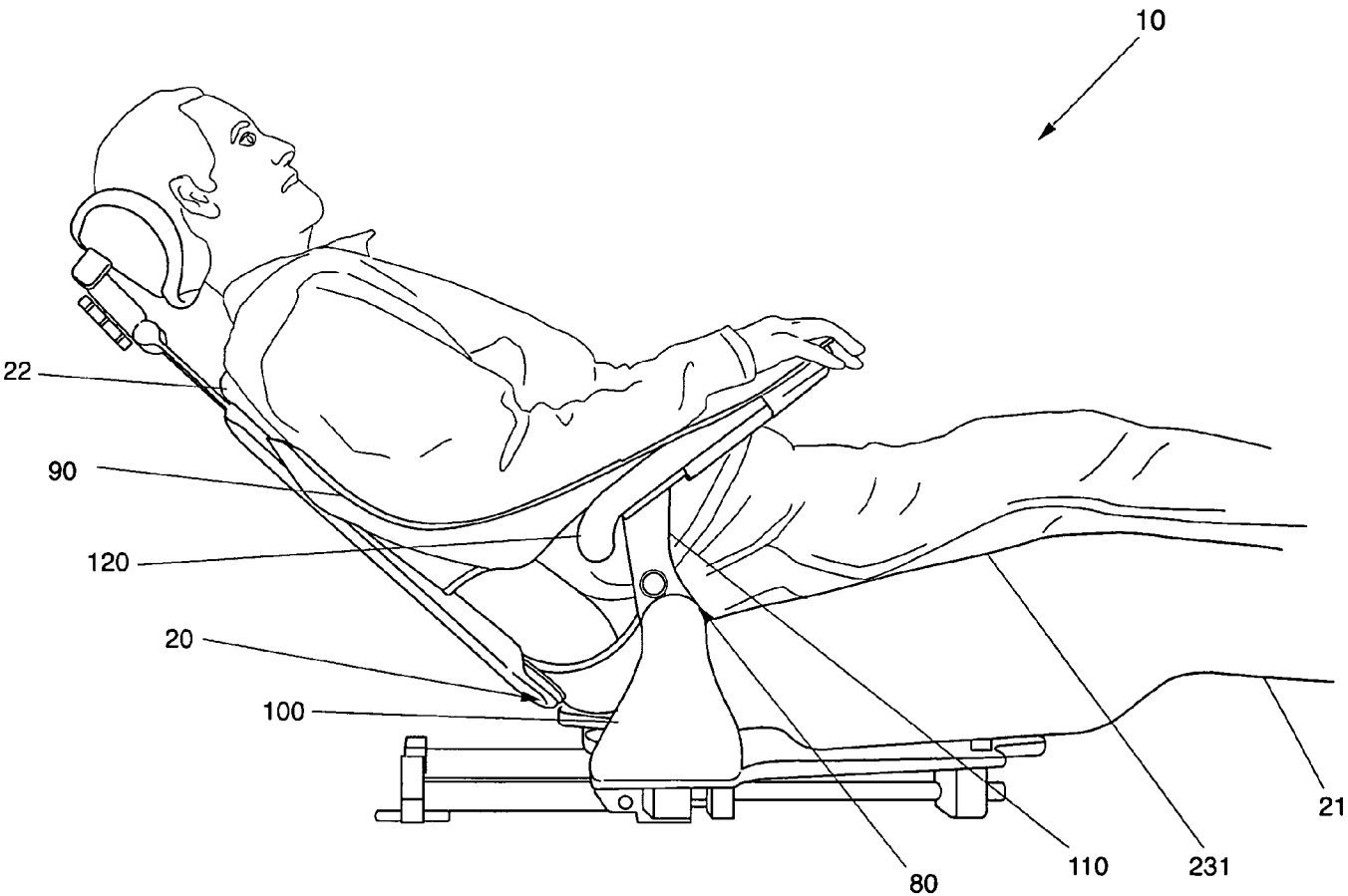
FIG. 13 left side view of the chair arm rest system of FIG. 4 in operation at a third position.

In FIG. 13, the chair 20 is in a third position about midway between the inclined and reclined position. In the third position, the arm rest post 110 is moving rearward towards the vertical chair member 22. For the most part, the arm rest post 110 independently and uniquely pivots throughout the range of positions of the chair 20.

Figure 14:
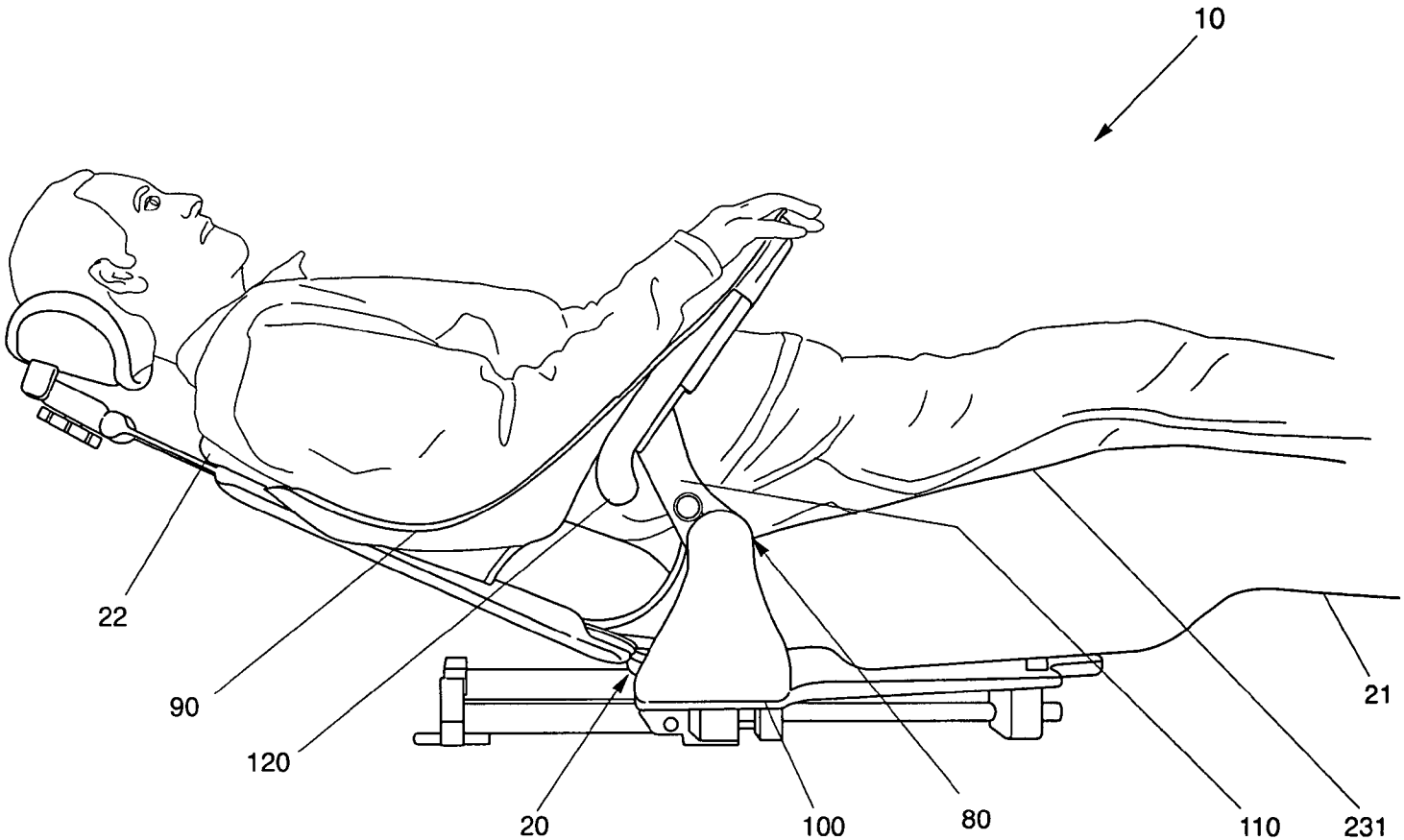
FIG. 14 left side view of the chair arm rest system of FIG. 4 in operation at a fourth position.
Figure 15:
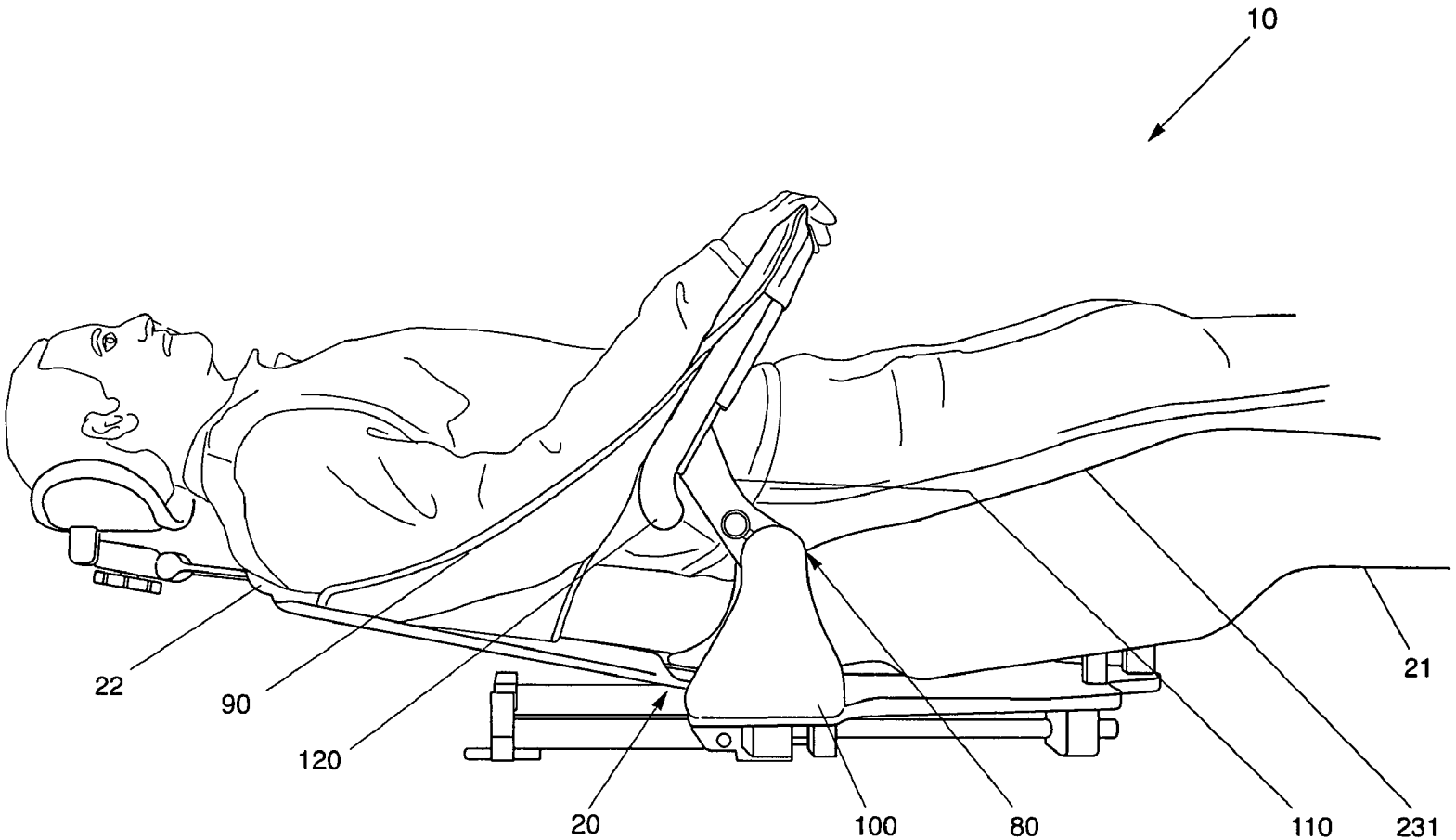
FIG. 15 is a left side view of the chair arm rest system of FIG. 4 in operation at a fifth position or reclined position.

In FIG. 14, the chair 20 is in a fourth position. In the fourth position, the arm rest post 110 continues its rearward movement to maintain a comfortable tension of the sling 90 while self-adjusting the arm-rest post 110 throughout the range of movement of the chair 20. In FIG. 15, the chair 20 is in a fifth position or fully reclined. The fifth position is where many users will spend time sedated during operative procedures. As a result, the fifth position is where the benefit of the self-tensioning chair arm rest system 10 that ergonomically supports the arms, shoulder, and hands of the user is most keenly recognized.

Also, the sling 40,90 and head rest 200 of a chair may be fully adjustable, such as being inflatable, as desired, to achieve the desired comfort and positioning of the user. In addition, the sling 40,90 may contain a webbing for locally adjusting tension of the sling 40,90 for a customized fit for a user.

It should be understood that the present invention is well-suited and preferably used in a dental or ophthalmic office environment, such as for a dental or ophthalmic chair, however, it may be used in any environment where a user or person needs to be supported. The invention will be disclosed herein in connection with use in a dental office environment, however, the present invention is not intended to be limited to that particular use or environment.

In view of the foregoing, a new and novel improved ergonomic chair arm rest system 10 is provided. The present invention uniquely provides a self-tensioning or self-adjusting chair arm rest system 10 which provides a ergonomic support for a user's hands, arms, and shoulders. Specifically, the chair arm rest system 10 self-tensions the sling 40,90 when the chair 20 moves from an inclined to a reclined position and pivots the spring-biased arm rests 30,80 towards the vertical chair member 22. Throughout the range of movement of the chair arm rest system 10, the sling 40,90 and the arm rests 30,80 ergonomically support the hands, arms, and shoulders of the user.

Therefore, while there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A chair arm rest system, comprising:

a chair having a vertical chair member hingedly connected to a horizontal chair member;

a base proximal to the vertical chair member having a top end and a bottom end, the bottom end of the base attached to the horizontal chair member;

an arm rest post spring-biased towards the horizontal chair member, the arm rest post having a proximal end and a distal end, the distal end of the arm rest post pivotally attached to the top end of the base;

an arm rest surface attached to the proximal end of the arm rest post;

a sling, having a first end and a second end, the first end of the sling attached to the vertical chair member, the second end of the sling connected to the arm rest surface; and whereby moving the vertical chair member relative to the horizontal chair member self-adjusts the sling and pivots the spring-biased arm rest post towards the vertical chair member.

2. The chair arm rest system of claim 1, further comprising:

a spring positioned between the arm rest post and the base to spring-bias the arm rest post towards the horizontal chair member.

3. The chair arm rest system of claim 1, further comprising:

a stop is attached to the arm rest post to limit the forward spring-biased travel of the arm rest post.

4. The chair arm rest system of claim 1, wherein the arm rest surface has an inner portion and an outer portion.

5. The chair arm rest system of claim 4, wherein the second end of the sling defines a sleeve for fitting over an outer portion of the arm rest surface.

6. The chair arm rest system of claim 1, wherein the first end of the sling has a width at least twice the size of a width of the second end of the sling.

7. The chair arm rest system of claim 1, wherein the sling has a substantially increased width along a length between the vertical chair member and the chair arm rest surface.

* * * * *